United States Patent [19]

Kirby et al.

[11] Patent Number: 4,571,740

[45] Date of Patent: Feb. 18, 1986

[54] RECREATION APPARATUS

[75] Inventors: Ronald S. Kirby, Worcester; Richard J. Bergstrom, Shrewsbury, both of Mass.

[73] Assignee: International Leisuretime Products, Inc., Shrewsbury, Mass.

[21] Appl. No.: 538,152

[22] Filed: Oct. 3, 1983

[51] Int. Cl.[4] ..... H04B 1/08

[52] U.S. Cl. ..... 455/344; 62/371; 62/457; 206/216; 312/7.1; 312/237; 312/246; 455/351

[58] Field of Search ..... 455/344, 347, 351, 346; 312/7.1, 245, 246, 214, 237, 223; 206/542, 216; 62/371, 331, 457; D14/68–72

[56] References Cited

U.S. PATENT DOCUMENTS

| | | | |
|---|---|---|---|
| D. 152,125 | 12/1948 | Peterson | 455/347 |
| 1,577,727 | 3/1926 | Karge | 455/344 |
| 2,062,632 | 12/1936 | Amdur | 455/344 |
| 2,671,623 | 3/1954 | Toulmin, Jr. | 455/344 |
| 3,179,891 | 4/1965 | Sharma | D14/72 |
| 3,496,889 | 2/1970 | Protzmann et al. | 312/245 |
| 4,279,342 | 7/1981 | Van Pelt | 206/542 |

*Primary Examiner*—Marc E. Bookbinder

*Attorney, Agent, or Firm*—Norman S. Blodgett; Gerry A. Blodgett

[57] ABSTRACT

Apparatus consisting of an insulated container to the surface of which is attached an auxiliary panel containing a radio and loudspeakers.

7 Claims, 10 Drawing Figures

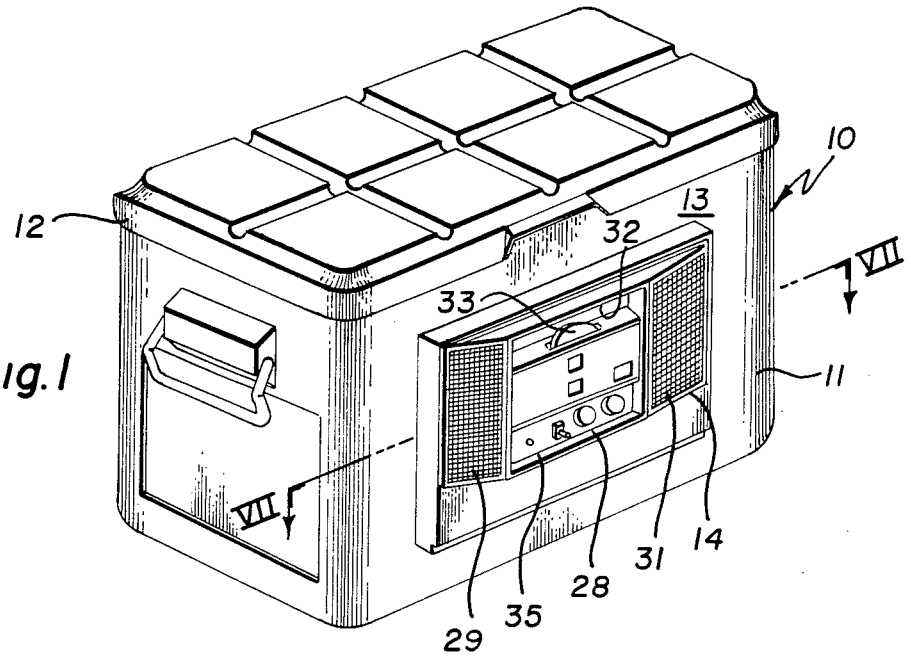
Fig. 1
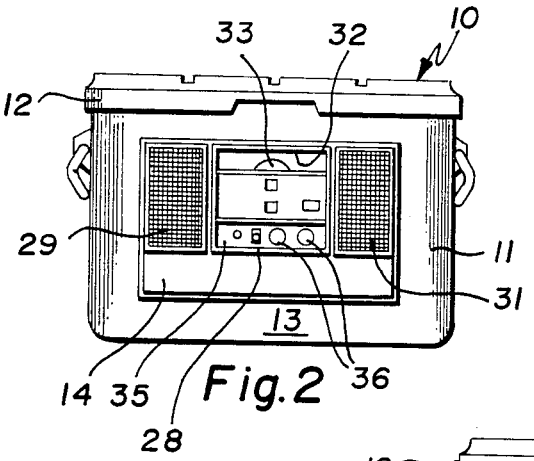
Fig. 2
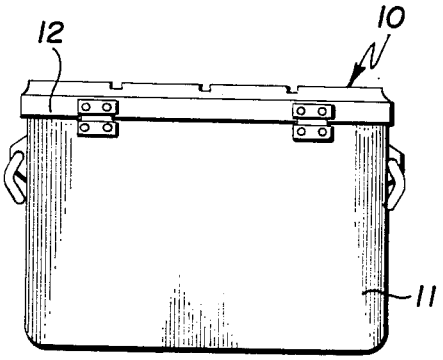
Fig. 3
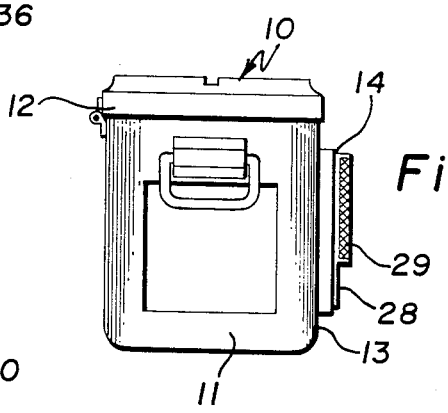
Fig. 4
Fig. 5
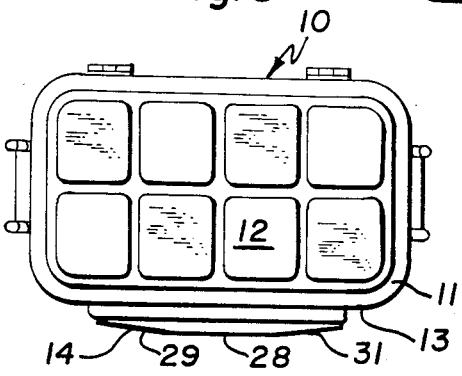
Fig. 6
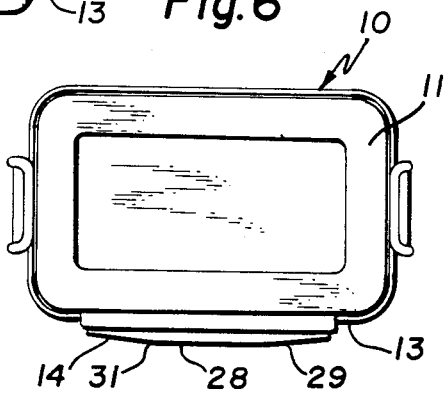

RECREATION APPARATUS

BACKGROUND OF THE INVENTION

There are many occasions, such as a picnic, where it is desirable to have available an insulated container for food and drink, and also have entertainment in the form of a radio receiver. When these items are carried separately, there is a tendency, particularly for the radio, because it is small, to become lost or stolen. Furthermore, on a sandy beach it is not desirable to allow the radio to sit in the sand. Also, in order to improve the quality of reception, it is desirable to raise the radio substantially above the ground surface and also to provide it with a resonant background. In addition, it is desirable, particularly in the case of stereo frequency modulated signals, to have spaced loud speakers directed at an angle to one another. Hoever, a radio capable of performing this function is rather bulky and difficult to store, carry, and set up at the picnic. In addition, because a portable radio is relatively small, it is easily stolen by a passerby at the picnic or beach. These and other difficulties experienced with the prior art devices have been obviated in a novel manner by the present invention.

It is, therefore, an outstanding object of the invention to provide a recreation apparatus in which an insulated container acts as a support element for a radio panel.

Another object of this invention is the provision of an apparatus in which an insulated container acts as a resonant support for a portable radio.

A further object of the present invention is the provision of an apparatus in which a portable radio is rendered difficult to steal, because it is attached to a larger element.

It is another object of the instant invention to provide a recreation apparatus in which the acoustical qualities of a portable AM/FM stereo radio are enhanced by attachment to a large and useful additional element.

A still further object of the invention is the provision of a recreational apparatus which is simple in construction, which is inexpensive to manufacture, and which is capable of a long life of service with a minimum of maintenance.

SUMMARY OF THE INVENTION

In general, the invention consists of a recreational apparatus having an insulated container with a cover and a front wall. An auxiliary panel is mounted on the container and has mounted in it a radio and a loudspeaker. A connecting means is provided to join the auxiliary panel to the front wall for separation therefrom on occasion.

More specifically, the front wall of the container is provided with a plurality of vertical slots and the said connecting means consists of fasteners on the auxiliary panel to engage the slots. The auxiliary panel is in the form of a shell having angulated side faces behind which are mounted loudspeakers. A central face is formed with a substantial recess in its upper portion and a tuning disk for the radio is located in that recess.

BRIEF DESCRIPTION OF THE DRAWINGS

The character of the invention, however, may be best understood by reference to one of its structural forms, as illustrated by the accompanying drawings, in which:

FIG. 1 is a perspective view of recreation apparatus embodying the principles of the present invention, FIGS. 2, 3, 4, 5, and 6 are front elevational, rear elevational, side elevational, top plan, and bottom views, respectively, of the recreation apparatus.

DESCRIPTION OF THE PREFERRED EMBODIMENT

Figure 7:
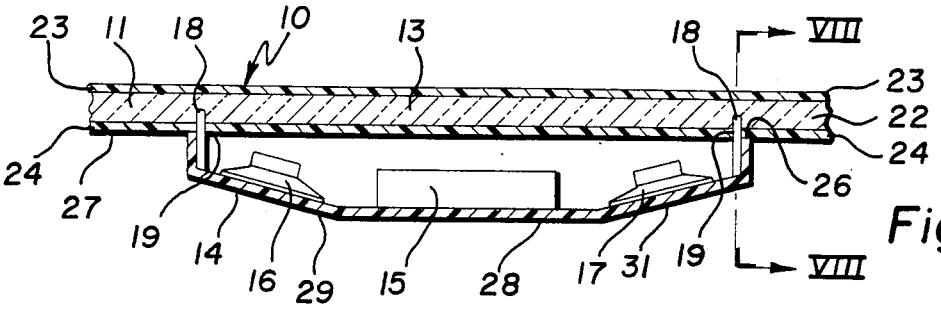
FIG. 7 is horizontal sectional view of the invention taken on the line VII—VII of FIG. 1.

Referring first to FIGS. 1–6, which best show the general features of the invention, it can be seen that the recreation apparatus indicated generally by the reference numeral 10, included an insulated container 11 having a cover 12 and a front wall 13. The apparatus is also provided with an auxiliary panel 14 in which is mounted a radio 15 and loudspeakers 16 and 17 (see FIG. 7).

Figure 8:
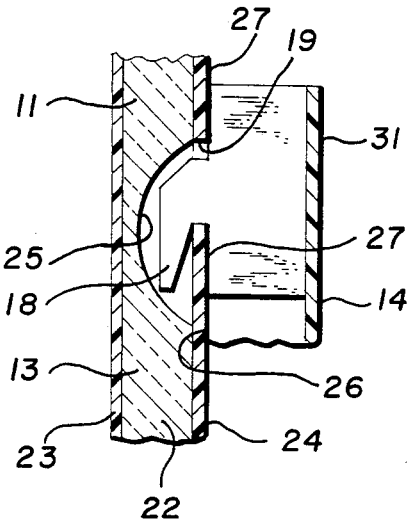
FIG. 8 is a vertical sectional view of the invention taken on the line VIII—VIII of FIG. 7.

Referring next to FIGS. 7 and 8, it can be seen that connecting means 18 is provided to join the auxiliary panel to the said front wall 13 of the container for separation therefrom on occasion. The connecting means consists of a plurality of vertical slots 19 formed in the container and fasteners provided on the auxiliary panel 14 to engage the slots.

The said front wall 13 of the container 11, consists of a layer 22 of foamed plastic, such as polyurethane, sandwiched betwen inner and outer sheets 23 and 24, respectively, of relatively dense plastic. In FIG. 8 it can be seen that a suitable recess 25 is formed in the foamed plastic to receive a fastener behind each slot 19.

As is evident in FIG. 7, the auxiliary panel 14 is in the form of a plastic shell which opens to the rear (but which may be covered with a sheet to protect the contents) and has an edge 26 in the form of a closed rectangular figure. The edge lies in a single flat plane to engage closely to the outer surface 27 of the said front wall 13 of the container which outer surface is also flat to give a tight engagement between the auxiliary panel and the front wall of the container.

Figure 10:
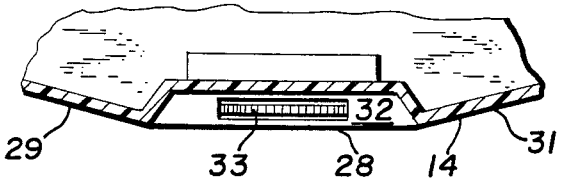
FIG. 10 is a horizontal sectional view of the apparatus taken on the line X—X of FIG. 9.

The auxiliary panel 14 has a central face 28 and two side faces 29 and 31, the side faces lying at acute angles to the central face, as is best shown in FIG. 7. As can be seen in FIGS. 7 and 10, the radio 15 is mounted behind the central face 28, the loudspeaker 16 is mounted behind the side panel 29, and the loudspeaker 17 is mounted behind the side face 31. The side faces 29 and 31 are suitably provided with perforations (not shown) and a decorative grill.

Figure 9:
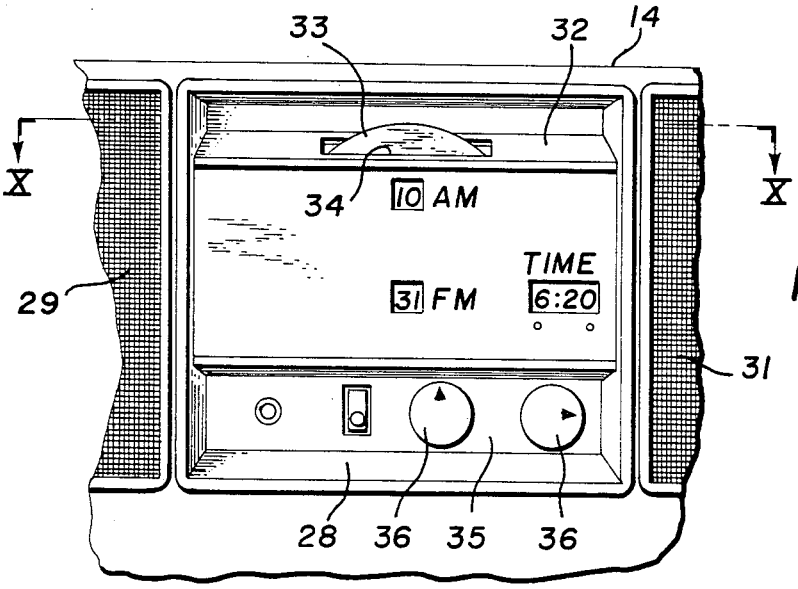
FIG. 9 is a front elevational view of a portion of the apparatus.

The central face 28 is formed with a substantial recess 32 in its upper portion and the radio 15 is provided with a tuning disk 33 that extends into the recess through a slot 34 (see FIG. 9) in the floor of the recess.

The central face 28 is also formed with a substantial recess 35 in its lower portion. The radio 15 is provided with control knobs 36 located on the back wall of the recess 35. As is obvious in FIG. 8, each connecting means 18 is in the form of a finger whose edge is inclined at a substantial angle act as a cam or wedge to draw the edge 26 of the auxiliary panel 14 tightly into engagement with the outer surface 27 of the front wall 13 of the container.

The operation and advantages of the present invention will now be readily understood in view of the above description. During use, the container 11 would normally be used as a cooler; that is to say, because of the insulating feature of the layer 22 are foamed plastic, the container will be capable of retaining drinks and food in a cool state for a considerable period of time. It would be moved by means of the handles at the ends with the cover 12 in place and can be easily carried to the picnic site, such as to the beach. When the container is carried in this way, because the auxiliary panel 14 and associated elements such as the radio 15 are attached to it, the radio is transported to the site with a minimum of difficulty. The opportunity to leave the radio in an automobile or to leave it behind on the beach when leaving is, of course, minimized. At the same time, because the radio is contained in the auxiliary panel 14 which in turn is firmly attached to the large container 11, it is difficult for someone to steal the radio simply by passing by the picnic site, picking up the radio, and moving off rapidly. In other words, it is quite obvious when one tries to walk away with a large container, while stealing a smaller radio is not so easily noticed. At the same time, the auxiliary panel can be removed to replace batteries and to repair loudspeakers if such be necessary. The fact that the loudspeakers 16 and 17 are located at acute angles to the central panel causes the sound and acoustical effect to be enhanced. The fact that the entire elements are mounted on a hollow auxiliary panel, which in turn is mounted on a large hollow container 11, means that the vibratory acoustical effects are also increased. The musical effect is excellent, because of this combination. At the same time, the radio is protected from a sudden rain by the fact that the slot 34 from which the tuning disk 33 emerges is enclosed within the deep recess 32. Similarly, because it is necessary to run the control knobs 36 and the like through apertures in the wall of the auxiliary panel, they are also located in a deep recess 35 which protects them from direct flow of water during a rain. It also protects them from sand and dust which may fall vertically on the assemblage.

It can be seen, then, that the present recreational apparatus provides a very useful assemblage in that it not only provides a means of carrying a high fidelity radio to and from a picnic site, but the means of carrying it is in the form of a useful insulated container which provides acoustical enhancement effects for the radio and also ensures that the radio is difficult to steal. Furthermore, it ensures that the user will not forget to carry the radio to and from the picnic site. In addition, the assemblage has a pleasing appearance which makes it also desirable from an aesthetic point of view.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Recreation apparatus, comprising:

(a) an insulated container having a cover and a front wall, said front wall consisting of a layer of foamed plastic sandwiched between inner and outer sheets of relatively dense plastic said outer sheet being provided with a plurality of vertical slots, and a recess is formed in the foamed plastic behind each slot, (b) an auxiliary panel in which is mounted a radio and a loudspeaker, and (c) a plurality of fastners on the auxiliary panel for engaging the slots and extending into said recesses for joining the auxiliary panel to the said front wall for separation therefrom on occasion.

2. Recreation apparatus, comprising:

(a) an insulated container having a cover and a front wall, (b) an auxiliary panel in which is mounted a radio and a loudspeaker said auxiliary panel being in the form of a shell that opens to the rear and has an edge in the form of a closed rectangular figure, all edges being coplanar to engage closely the outer surface of the said front wall of the container, and (c) connecting means to join the auxiliary panel to the said front wall for separation therefrom on occasion.

3. Recreation apparatus as recited in claim 2, wherein the auxiliary panel has a central face and two side faces, the radio being mounted behind the central face and a loudspeaker being mounted behind each side face.

4. Recreation apparatus as recited in claim 3, wherein each side face is arranged at an acute angle to the central face, wherein the central face is formed with a substantial recess in its upper portion, and wherein the radio is provided with a tuning disk that extends into the recess through a slot in the floor of the recess.

5. Recreation apparatus as recited in claim 4, wherein the central face is formed with a substantial recess in its lower portion, and wherein the radio is provided with control knobs located on the back wall of the recess.

6. Recreation apparatus, comprising:

(a) an open-topped container having a bottom wall and a plurality of vertical walls one of said vertical walls of the container being provided with a plurality of vertical slots and comprising a layer of foamed plastic which has a recess behind each slot, (b) a cover for said container, (c) an audio unit including a radio and a loudspeaker, and (d) fasteners on the audio unit to engage the slots and extend into said recesses for joining the audio unit with said one vertical wall.

7. Recreation apparatus, comprising:

(a) an insulated container having a cover and a front wall, said front wall consisting of a layer of foamed plastic sandwiched between inner and outer sheets of relatively dense plastic, said outer sheet being provided with a plurality of apertures, (b) an auxiliary panel in which is mounted a radio and a loudspeaker, and (c) a plurality of fasteners for fastening the auxiliary panel to the outside of said front wall, each of said fasteners having a first portion which is operatively connected to said auxiliary panel and a second portion which is adapted to lie between said inner and outer sheets and to bear against the inner surface of said outer sheet, said first and second portions being connected at said apertures.

* * * * *